US005078106A

United States Patent [19]

Matsuo et al.

[11] Patent Number: 5,078,106

[45] Date of Patent: Jan. 7, 1992

[54] V-TYPE ENGINE LUBRICATION SYSTEM

[75] Inventors: Isaya Matsuo; Toshiki Ohara, both of Yokohama, Japan

[73] Assignee: Nissan Motor Co., Ltd., Yokohama, Japan

[21] Appl. No.: 588,045

[22] Filed: Sep. 25, 1990

[30] Foreign Application Priority Data

Sep. 26, 1989 [JP] Japan ..... 1-112470[U]

[51] Int. Cl.[5] ..... F01M 1/00

[52] U.S. Cl. ..... 123/196 R; 123/198 C; 184/6.28

[58] Field of Search ..... 123/196 A, 196 R, 198 C; 474/138; 184/6.28, 26

[56] References Cited

U.S. PATENT DOCUMENTS

| | | | |
|---|---|---|---|
| 4,462,350 | 7/1984 | Kurata | 184/6.28 |
| 4,538,565 | 9/1985 | Hidaka | 123/196 R |
| 4,607,601 | 8/1986 | Kohler | 123/195 C |
| 4,753,201 | 6/1988 | Fukuo | 123/195 C |
| 4,827,881 | 5/1989 | Baker | 123/196 R |
| 4,883,031 | 11/1989 | Ampferer | 123/195 C |
| 4,977,870 | 12/1990 | Hashimoto | 123/196 R |

FOREIGN PATENT DOCUMENTS

| | | | |
|---|---|---|---|
| 0131808 | 8/1982 | Japan | 123/196 R |
| 61-18167 | 6/1986 | Japan . | |

*Primary Examiner*—E. Rollins Cross
*Assistant Examiner*—Erick Solis
*Attorney, Agent, or Firm*—Foley & Lardner

[57] ABSTRACT

In a V-type engine, a front casing is attached to a front end of a cylinder block and receives therewithin a sprocket and chain for transmission of engine power from a crankshaft to an oil pump. The front casing has at a peripheral portion on one side of cylinder block an oil pump mounting bracket which projects laterally outwardly of the cylinder block. The oil pump is installed on the oil pump mounting bracket in such a way as to be in a parallel relation to a crankshaft.

10 Claims, 6 Drawing Sheets

V-TYPE ENGINE LUBRICATION SYSTEM

BACKGROUND OF THE INVENTION

1. Field of the Invention

The present invention relates in general to V-type engines for automobiles, etc. and more particularly to a V-type engine lubrication system.

2. Description of the Prior Art

In a V-type engine lubrication system, its oil passage arrangement tends to become complicated or its associated engine tends to become large-sized due to the necessity of distributing lubricating oil to the left and right banks.

An example of this kind of lubrication system is disclosed in Japanese Utility Model Provisional Publication No. 61-18167 and is also shown in FIG. 6. In the FIG. 6 a cylinder block 81 is formed with an oil passage 82 extending across one of the banks for conducting lubricating oil to a main gallery (not shown) located between the banks.

An oil pump 83 is installed on a front casing 88 and adapted to be driven by an engine crankshaft by way of a pulley and belt.

Lubricating oil is drawn from a sump by the oil pump 83 and delivered through a pipe 84 on the side of the cylinder block 81 to oil filters 85, from which it is delivered through a pipe 86 and an oil cooler 87 to the oil passage 82.

In the lubrication system, cylinders in the left bank as viewed from the front end of the engine are offset a predetermined distance rearwardly from cylinders in the right bank, and the oil passage 82 is formed in an integral wall portion of the left bank, which wall portion results from the above offsetting.

In the meantime, terms "rearwardly" and "forwardly", "rear" and "front" are herein used with respect to a rear end and front end of an engine where a flywheel and cooling fan are respectively provided.

A problem of the lubrication system is that the oil passage 82 for providing communication between the main gallery and the oil pump 83 cannot be sufficiently large in diameter or bore since the amount of offsetting of the cylinders in the left bank cannot be sufficiently large due to design restrictions in the overall length, weight, etc. of the engine, resulting in that the pressure loss in the oil passage 82 is liable to become large and therefore making it impossible to attain efficient lubrication.

Another problem is that the pipes 84, 86 for providing communication between the oil passage 82 and the oil pump 83 by way of the oil filters 85 are lengthy and complicated in shape due to the necessity of arranging the oil pump 83 in such a way as to project forwardly from the front casing 88.

SUMMARY OF THE INVENTION

In accordance with the present invention, there is provided a V-type engine which comprises a cylinder block having a first set of cylinders in a first bank and a second set of cylinders in a second bank, the first set of cylinders being offset a predetermined distance rearwardly from the second set of cylinders, a crankshaft, a main gallery disposed between the first and second banks to extend in parallel with the crankshaft for supplying lubrication oil to the first and second banks, an oil pump for supplying pressurized lubrication oil to the main gallery, oil passage defining means for defining an oil passage for providing communication between the oil pump and the main gallery, power transmitting means for transmitting engine power from the crankshaft to the oil pump, and a front casing attached to a front end of the cylinder block and receiving therewithin the power transmitting means, the front casing having at a peripheral portion on a first bank side of the cylinder block an oil pump mounting bracket projecting laterally outwardly of the cylinder block, the oil pump being installed on the oil pump mounting bracket in such a way as to be in a parallel relation to the crankshaft, the front casing having an integral conduit portion constituting the oil passage defining means.

The above structure is effective for solving the above noted problems inherent in the prior art device.

It is accordingly an object of the present invention to provide a V-type engine which can make an oil passage arrangement, for providing communication between a main gallery and an oil pump, compact and simple and thereby efficiently reduce a pressure loss in the oil passage arrangement.

It is another object of the present invention to provide a V-type engine of the above described character which is equipped with a lubrication system and which is compact in size and efficient in operation.

It is a further object of the present invention to provide a V-type engine of the above described character which is equipped with the lubrication system and which is effective for reducing the overall length of the engine.

It is a further object of the present invention to provide a V-type engine of the above described character which is compact in size, light in weight and economical in manufacturing and assembling cost.

It is a further object of the present invention to provide a V-type engine of the above described character which can attain efficient cooling of lubricating oil and therefore can meet the demand for high output.

It is a further object of the present invention to provide a V-type engine of the above described character which is suited for adoption to an automotive vehicle.

DESCRIPTION OF THE PREFERRED EMBODIMENT

Figure 1:
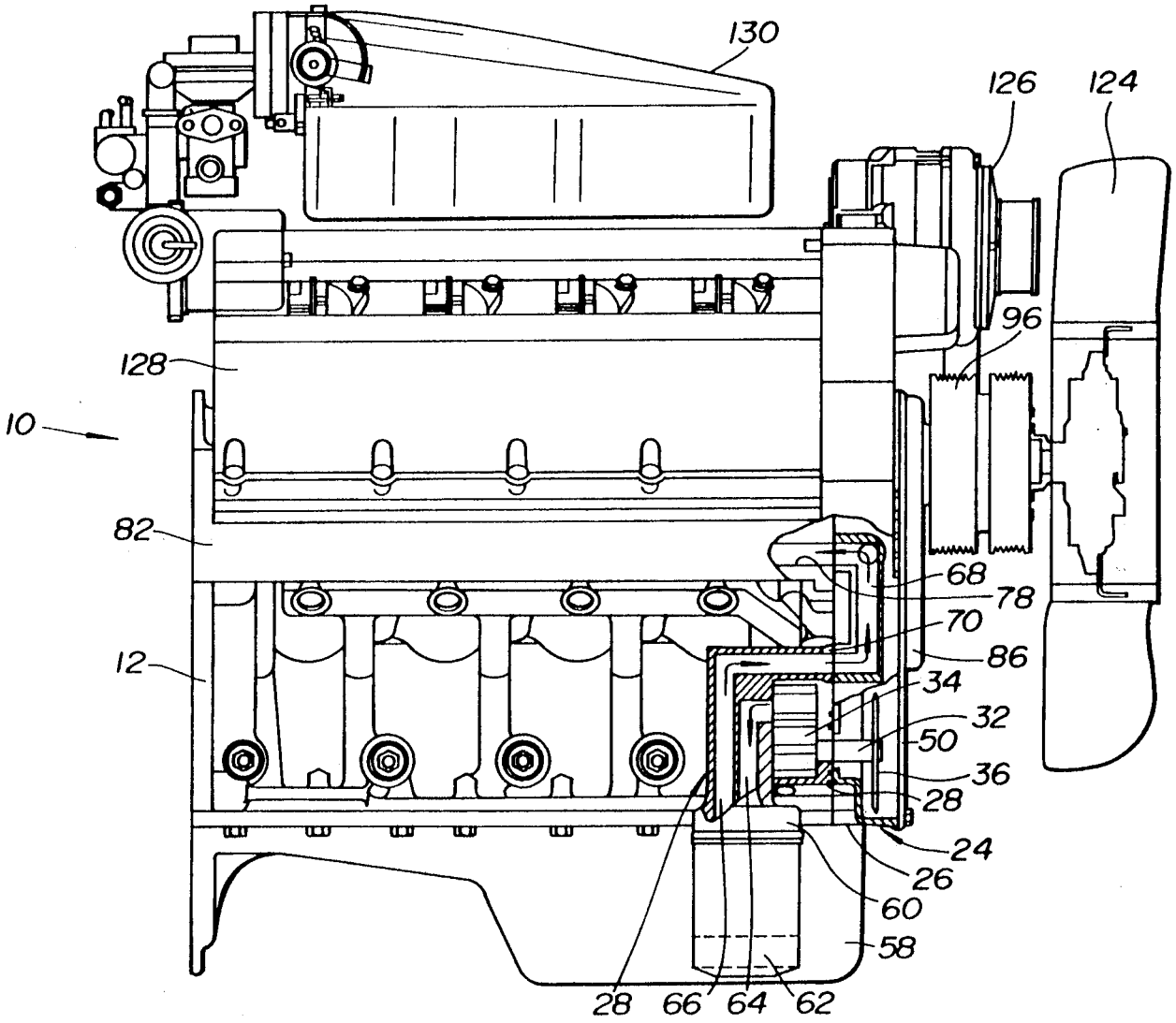
FIG. 1 is a side elevational view of a V-type engine according to an embodiment of the present invention.
Figure 2:
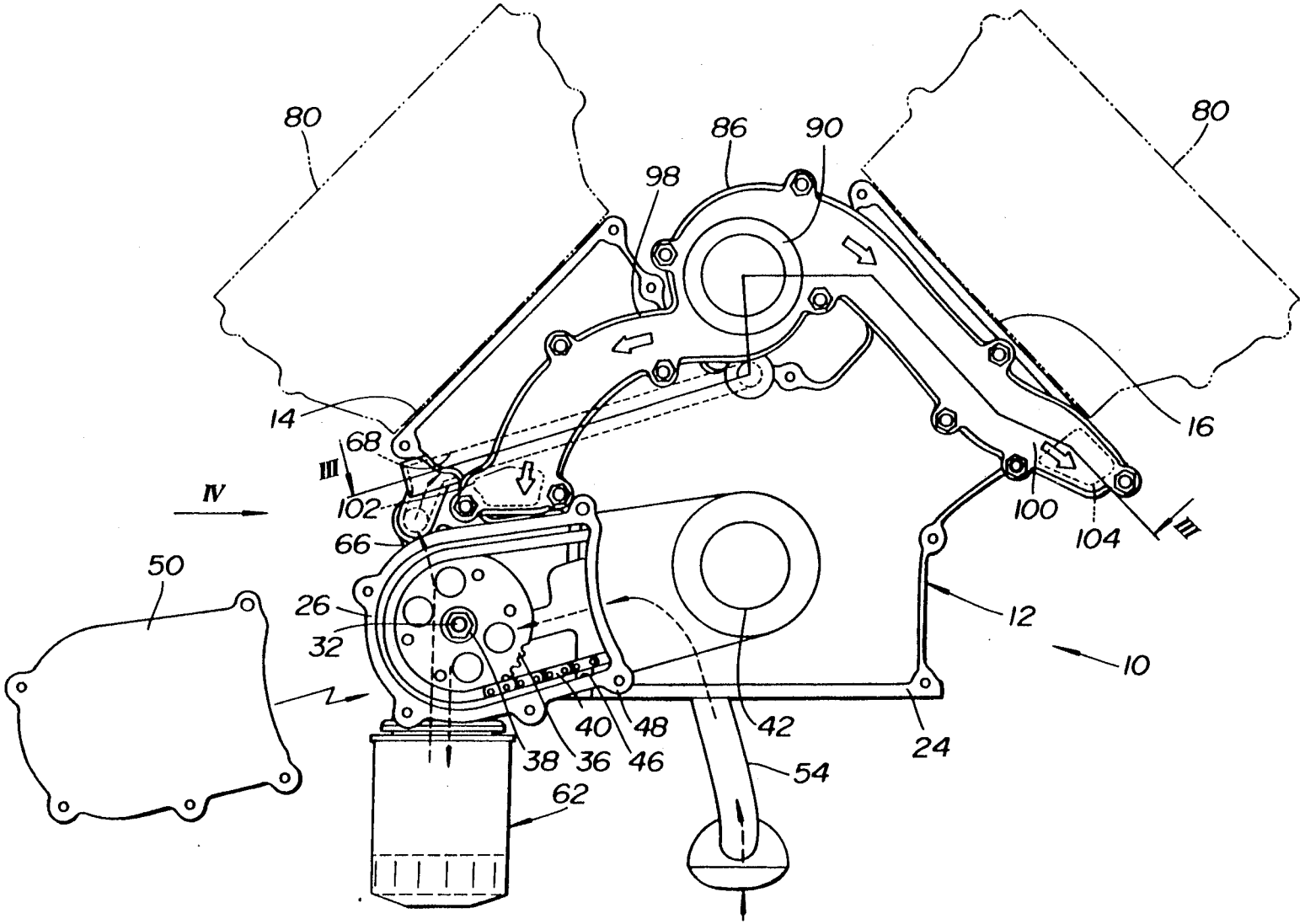
FIG. 2 is an elevational view of the V-type engine of FIG. 1, with some parts being omitted.
Figure 3:
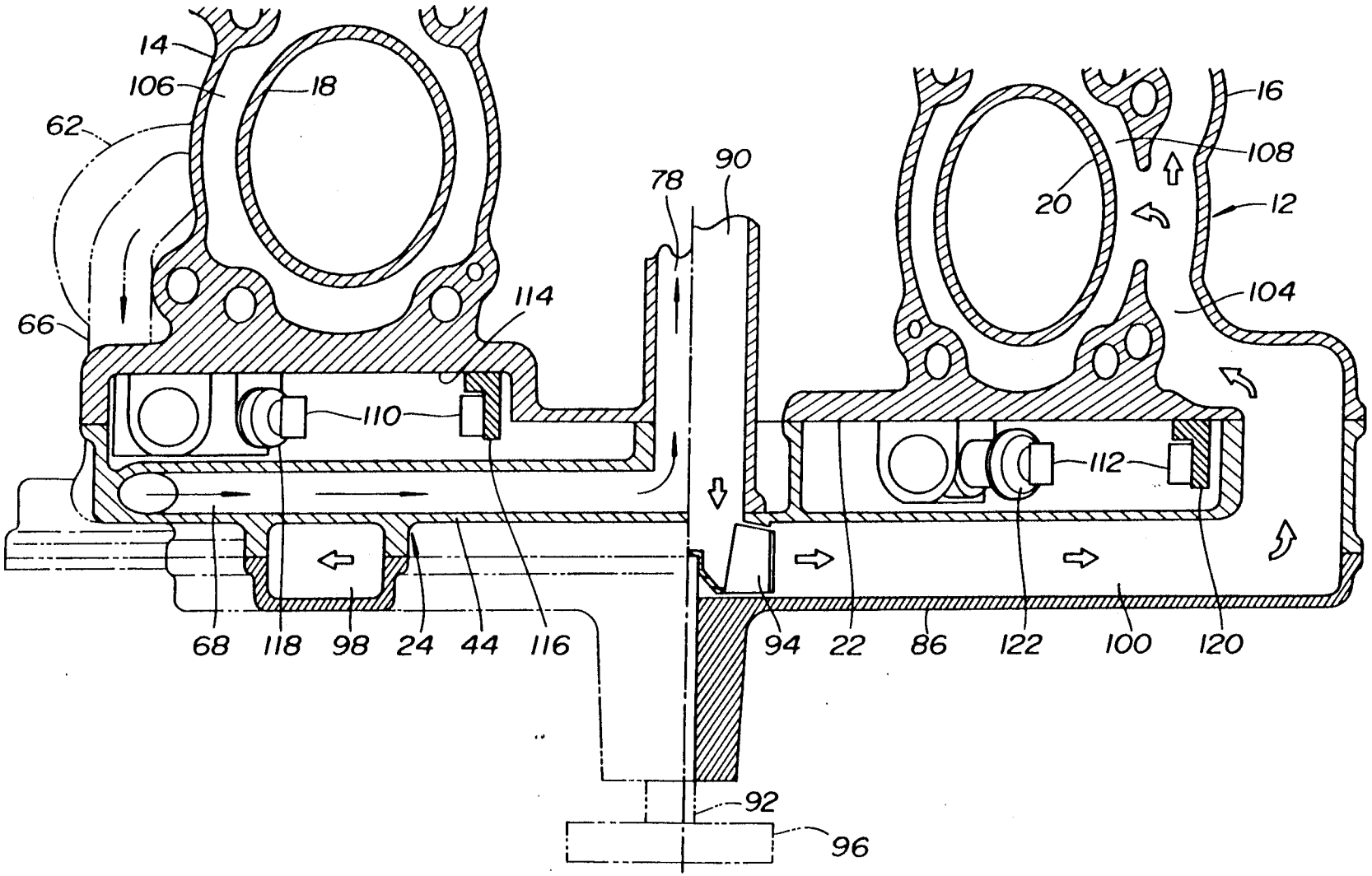
FIG. 3 is a sectional view taken along the line III—III of FIG. 2.
Figure 4:
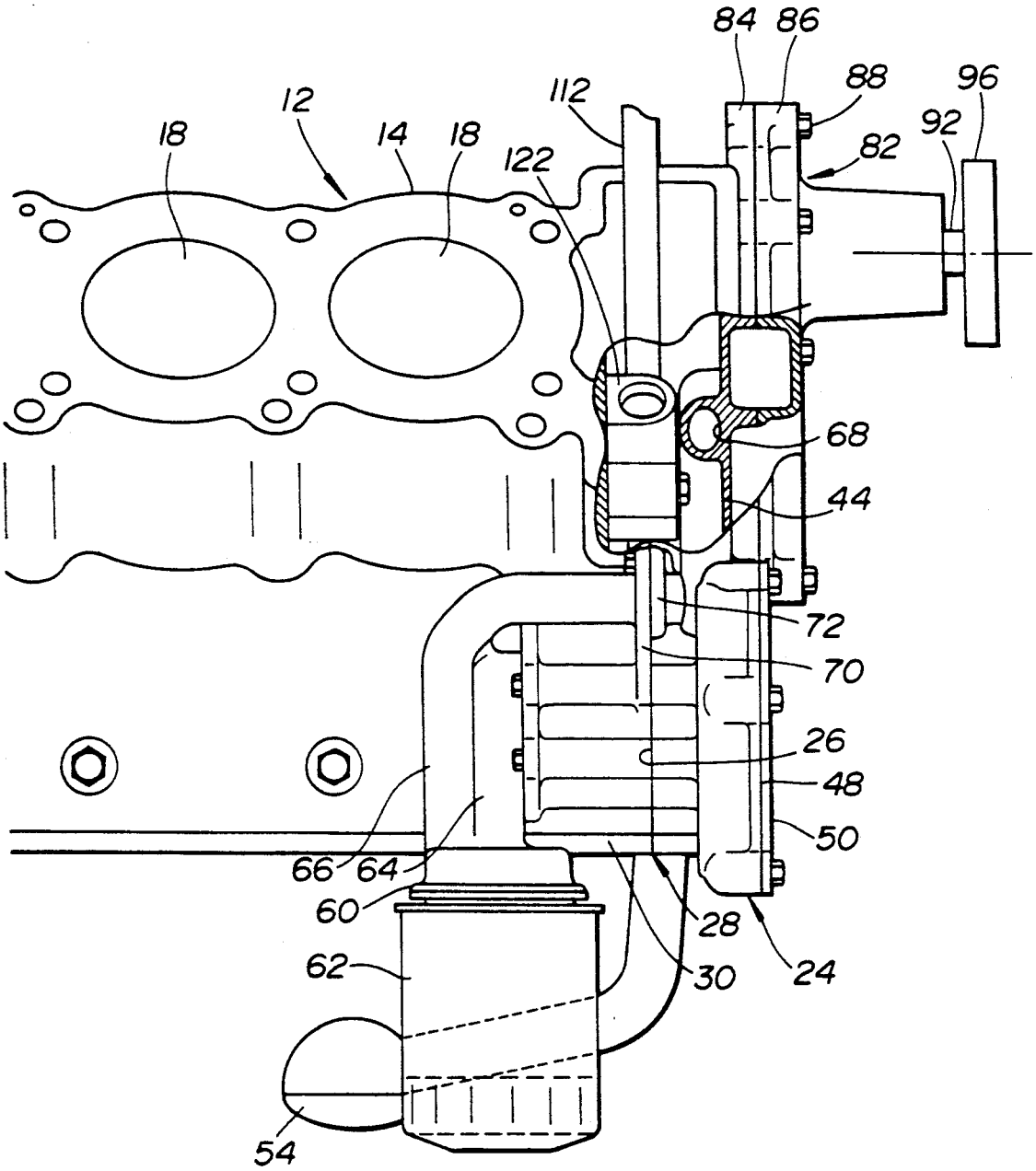
FIG. 4 is a view taken in the direction of the arrow IV of FIG. 2.
Figure 5:
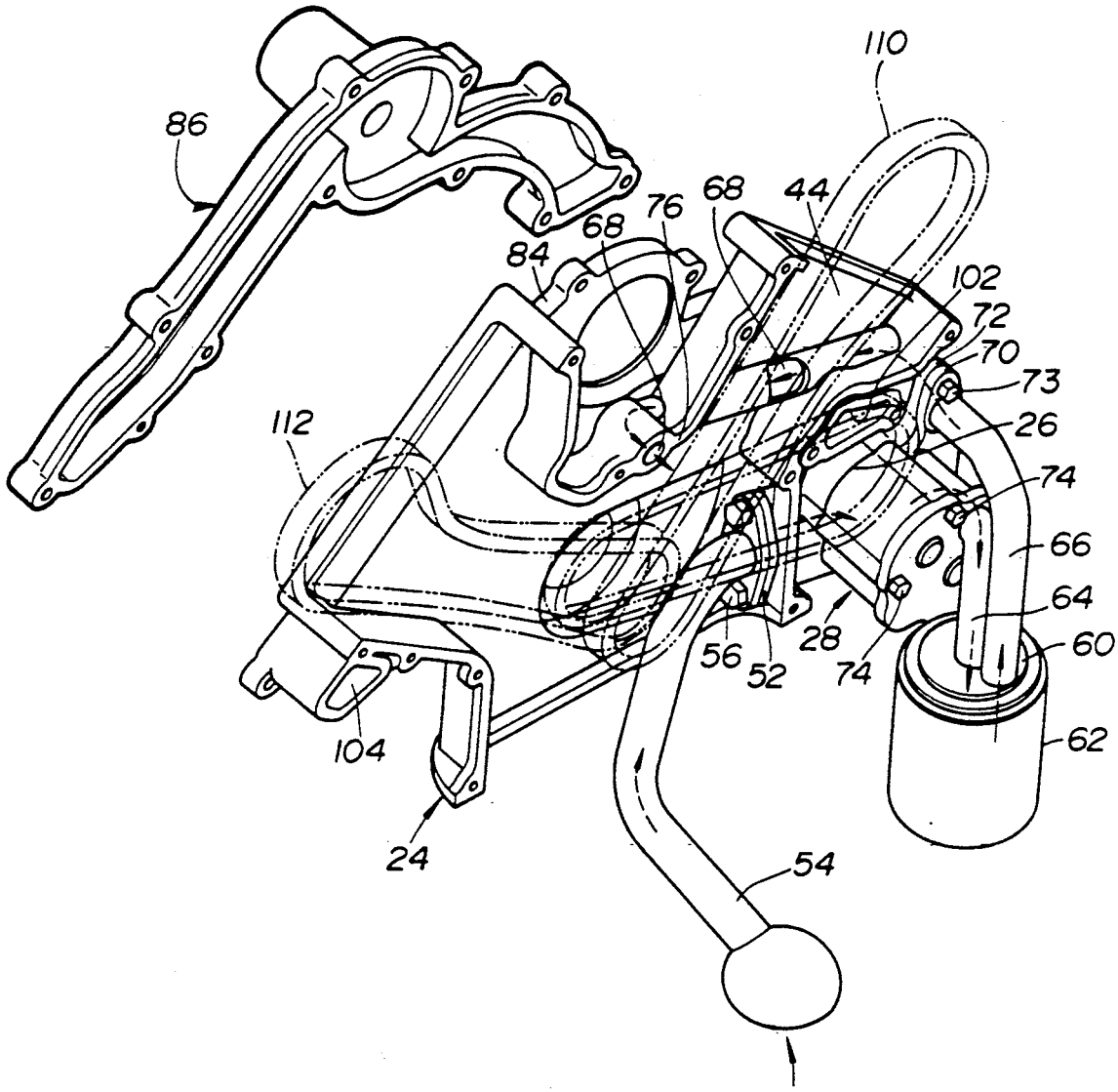
FIG. 5 is a perspective view of a front casing employed in the engine of FIG. 1, with some associated parts.
Figure 6:
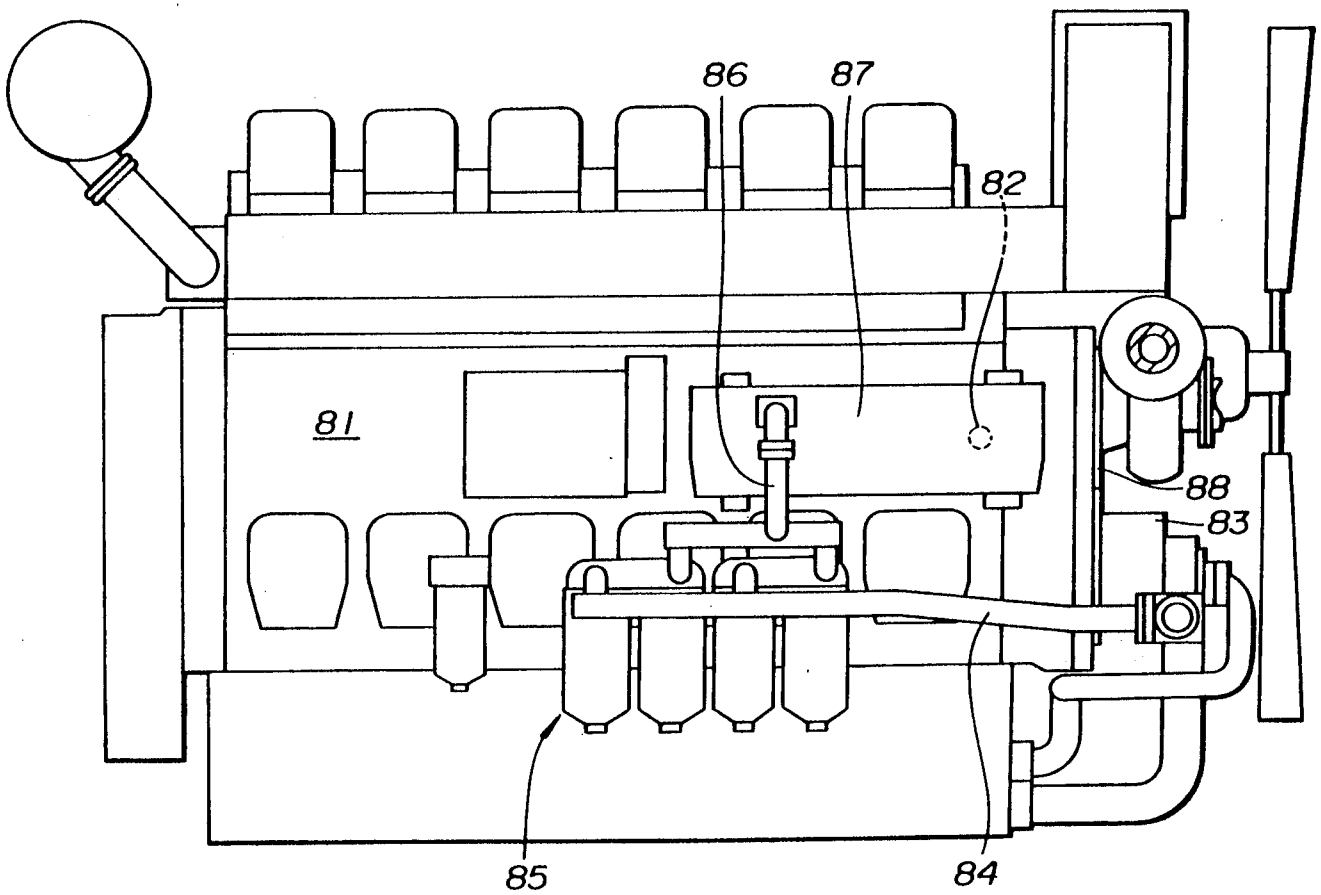
FIG. 6 (PRIOR ART)
FIG. 6 is a side elevational view of a prior art V-type engine.

Referring to FIGS. 1 to 5, a V-8 engine is generally indicated by the reference numeral 10 and includes an engine block 12 having left and right banks 14 and 16 as viewed from the front end thereof. Cylinders 18 in the left bank 14 are offset a predetermined distance rearwardly from cylinders 20 in the right bank 16.

The cylinder block 12 has a front end 22 to which a front casing 24 is attached to cover substantially all of the same. The front casing 24 has at a peripheral portion on the first bank 14 side of the cylinder block 12 an oil pump mounting bracket 26 projecting laterally outwardly of the cylinder block 12. An oil pump 28 consisting of an oil pump housing housing 30 is installed on the rear end of the oil pump mounting bracket 26 in such a way that a pump drive shaft 32 of the oil pump 28 extends longitudinally of the engine 10, i.e., in parallel to an engine crankshaft which will be described hereinlater.

The pump drive shaft 32 has installed at a rear end thereof a gear 34 used for delivery of lubricating oil and at a front end thereof a sprocket 36 which is fastened thereto with a nut 38. A chain 40 is placed around the sprocket 36 and another sprocket (not shown) installed on an engine crankshaft 42 for transmitting engine power to the oil pump 28.

The sprocket 36 and chain 40 are housed within the front casing 24 which has a front end wall 44 formed with an opening 46 for access to the sprocket 36 and chain 40. The front end wall 44 is further formed with a flange 48 around the opening 46 so that the opening 46 can be sealingly closed by a cover 50 which is installed on the flange 48 and fastened thereto with bolts. In assembly, the oil pump 28 is first installed on the oil pump mounting bracket 26 of the front casing 24, then the sprocket 36 with the chain 40 placed therearound is installed in the front casing 24 and fastened to the oil pump drive shaft 32 by having access to the inside of the front casing 24 through the opening 44.

The front casing 24 has at an inner peripheral wall adjacent to the pump mounting bracket 26 a flange 52 to which an oil strainer 54 is fastened with bolts 56 so that lubricating oil in an oil sump 58 is drawn through the strainer 54 to the oil pump 28.

The oil pump 28 also has an oil filter mounting bracket 60 integral with the oil pump housing 30. An oil filter 62 is installed on the oil filter mounting bracket 60 in such a way that the oil filter 62 is located by the side of the oil pump 28. More specifically, the oil filter 62 is positioned rearwardly of and below the oil pump 28. The oil pump 28 further has a first upstream pipe 64 located downstream of the oil filter mounting bracket 60 and a second upstream pipe 66 located upstream of same. The first and second upstream pipes 60, 66 extend between the oil filter mounting bracket 60 and the housing 30 to integrally interconnect the same. Lubricating oil discharged from the oil pump 28 is supplied through the first upstream pipe 64 to the oil filter 62 for filtration thereby, from which it is delivered through the second upstream pipe 66 to an oil passage 68 which will be described hereinafter.

The second upstream pipe 66 has at an upstream end thereof a flange 70 integral with the oil pump housing 28 and joined with a flange 72 which is integral with the front casing 24. The oil pump housing 30 is fastened to the front casing 24 with a bolt 73 extending through the flanges 70, 72, and with bolts 74 extending through the overall length of the pump housing 30.

The front casing 24 has the above described oil passage 68 extending laterally along the front end wall 44, i.e., extending along the front end 22 of the cylinder block 12 in the crosswise direction of the first bank 14. The oil passage 68 has an end in communication with the flange 72 which is joined with the flange 70 such that the oil passage 68 is in communication through the flanges 70, 72 with the oil pump 28. The other end of the oil passage 68 is in communication with a flange 76 which is joined with the cylinder block 12 such that the oil passage 68 is communicated with a main gallery 78 through the flange 76.

The main gallery 78 is defined by an integral conduit portion of the cylinder block 12 at a location intermediate between the left and right banks 14 and 16 in such a way as to extend in parallel with the engine crankshaft 42 so that lubrication oil filterated by the oil filter 62 flows through the oil passage 68 into the main gallery 78, from which it is delivered through branch passages (not shown) to the working parts such as the crankshaft 42, valve trains in a cylinder head 80, etc. to lubricate the same.

The front casing 24 has installed on the upper central portion thereof a water pump 82. To this end, the front casing 24 has at the upper central portion thereof an integral water pump mounting bracket 84. A water pump housing 86 is disposed on the front side of the water pump mounting bracket 84 and fastened thereto with a plurality of bolts 88. A suction pipe 90 is disposed on the rear side of the water pump mounting bracket 84 and connected thereto. A water pump drive shaft 92 is rotatably installed on the water pump housing 86 and has a rear end on which a vane 94 is installed and a front end on which a pulley 96 is installed. Though not shown, a belt is placed around the pulley 96 for transmitting engine power from the $ engine crankshaft 42 to the water pump drive shaft 92. Water passages 98, 100 are defined between the front casing 24 and the water pump housing 86 and extend along the front ends of the left and right banks 14, 16 in the crosswise direction of same. The water passages 98, 100 are connected at one ends thereof to water galleries 102, 104 disposed on the respective sides of the left and right banks 14, 16 so that by rotation of the vane 94, coolant is drawn from the suction pipe 90 and delivered through the water passages 98, 100 to the water galleries 102, 104, from which it is delivered through water jackets 106, 108 of the cylinder block 12.

Chains 110, 112 are disposed in the space between the front casing 24 and cylinder block 12 for transmitting power from the engine crankshaft 42 to left and right camshafts (not shown) for driving valve trains.

The cylinder block 12 is formed at the front end 22 with a recess 114 which receives therein the cam drive chain 110 for the left bank 14. A chain guide 116 and chain tensioner 118 in contact with the cam drive chain 110 for applying thereto a predetermined tension are installed in the recess 114.

The cylinder block 12 has further installed on the front end 22 thereof a chain guide 120 and chain tensioner 122 in contact with the cam drive chain 112 for the right bank 16 for applying thereto a predetermined tension.

Each of the chains 110, 112 are offset from each other correspondingly to the offsetting of the cylinders in the left and right banks 14, 16 such that a space for arrangement of the oil passage 68 is obtained between the front end wall 44 of the front casing 24 and chain 110.

The engine 10 is further provided with a cooling fan 124, an alternator 126, a rocker cover 128 installed on the cylinder head 80, and an intake manifold 130.

In operation, lubricating oil circulates through the engine 10 as indicated by the solid and dotted line arrows in the drawings. That is, lubricating oil in the oil sump 58 is drawn through the oil strainer 54 into the oil pump 28 so that relatively large particles are removed from the lubricating oil prior to its being supplied to the oil pump 28. By the oil pump 28, lubricating oil is pressurized and delivered through the pipe 64 to the oil filter 62. After removal of relatively small particles by the oil filter 62, lubricating oil is delivered through the pipe 66 and oil passage 68 to the main gallery 78. From the main gallery 78, lubricating oil is supplied to the working parts of the engine 10 to lubricate the same and then returned to the oil sump 58.

From the forgeoing, it will be further understood that the engine 10 can be compact, particularly can be shorter in overall length as compared with the prior art engine due to the effect of installing the oil pump 28 on the side of the cylinder block 12.

It will be further understood that the oil passage 68 can be larger in diameter or bore as compared with the corresponding passage in the prior art arrangement and therefore the pressure loss in that passage can be smaller since the oil passage 68 is not formed in the cylinder block 12 but in the front casing 12.

It will be understood that the oil pump 28 can be installed on the front casing 24 with ease and efficiency by the effect of the opening 46 which is formed in the front casing 24 for enabling the sprocket 36 and chain 40 to be installed therethrough in the front casing 24 after installation of the oil pump 28 on the pump mounting bracket 26.

It will be further understood that the oil pump 28 can be lower in sealing accuracy as compared with the prior art device since the oil pump 28 is sealingly covered by the front casing 24 which is in turn sealed to the front end 22 of the cylinder block 12 such that lubricating oil leaking from the oil pump 28 is collected inside the front casing 24, from which it is returned to the oil sump 58.

It will be further understood that arrangement of the oil filter 62 by the side of the oil pump 28 is effective for reducing the pressure loss in the pipes 64, 66 since such an arrangement of the oil filter 62 can make the pipes 64, 66 short (i.e., compact) and simple in shape.

It will be further understood that integral connection of the oil filter mounting bracket 60 with the oil pump housing 30 by means of the pipes 64, 66 is further effective for making the pipes 64, 66 short (i.e., compact) and simple in shape and reducing the pressure loss in those pipes.

It will be further understood that arrangement of the recess 114 in the first bank 14 portion of the front end 22 of the cylinder block 12 for receiving therein the cam chain 110 is effective for the provision of the oil passage 68 between the cam chain 110 and the water passage 98 without causing substantial increase of the overall length of the engine 10.

It will be further understood that arrangement of the oil passage 68 inside the front casing 24 enables the water passages 98, 100 to be arranged not in an offset formation but in a common plane such that coolant discharged from the water pump 82 can be distributed uniformly to the left and right banks 14, 16.

It will be further understood that the oil passage 68 is defined by the integral conduit portion of the front casing 24 such that the heat of lubricating oil is efficiently radiated to the outside air which flows against the front casing 24 being propelled by the cooling fan 124 and that the heat of the lubricating oil, under an engine operating condition where the temperature of lubricating oil is high, is further radiated to the coolant flowing through the water passages 98, 100, thus making it possible to prevent overheating of lubricating oil efficiently and therefore making it possible to attain a high output.

What is claimed is:

1. A V-type engine comprising:

a cylinder block having a first set of cylinders in a first bank and a second set of cylinders in a second bank;

said first set of said cylinders being offset a predetermined distance rearwardly from said second set of said cylinders;

a crankshaft;

a main gallery disposed between said first and second banks to extend in parallel with said crankshaft for supplying lubrication oil to said first and second banks;

an oil pump for supplying pressurized lubrication oil to said main gallery;

oil passage defining means for defining an oil passage for providing communication between said oil pump and said main gallery;

power transmitting means for transmitting power from said crankshaft to said oil pump; and a front casing attached to a front end of said cylinder block and receiving therewithin said power transmitting means;

said front casing having at a peripheral portion on a first bank side of said cylinder block an oil pump mounting bracket projecting laterally outwardly of said cylinder;

said oil pump being disposed behind said oil pump mounting bracket and installed on same in such a way that said oil pump is positioned side-by-side with said cylinder block and is in a parallel relation with said crankshaft;

said front casing having an integral conduit portion constituting said oil passage defining means.

2. The engine as set forth in claim 1 wherein said power transmitting means comprises a sprocket and chain drivingly connecting said oil pump to said crankshaft.

3. A V-type engine comprising:

a cylinder block having a first set of cylinders in a first bank and a second set of cylinders in a second bank;

said first set of said cylinders being offset a predetermined distance rearwardly from said second set of said cylinders;

a crankshaft;

a main gallery disposed between said first and second banks to extend in parallel with said crankshaft for supplying lubrication oil to said first and second banks;

an oil pump for supplying pressurized lubrication oil to said main gallery;

oil passage defining means for defining an oil passage for providing communication between said oil pump and said main gallery;

power transmitting means comprising a sprocket and a chain for transmitting power from said crankshaft to said oil pump;

an oil filter disposed between said oil pump and said oil passage; and a front casing attached to a front end of said cylinder block and receiving therewithin said power transmitting means;

said front casing having at a peripheral portion on a first bank side of said cylinder block an oil pump mounting bracket projecting laterally outwardly of said cylinder;

said oil pump being installed on said oil pump mounting bracket in such a way as to be in a parallel relation to said crankshaft, and said oil pump having an oil pump housing installed on a rear end of said pump mounting bracket and an oil filter mounting bracket integral with said oil pump housing which supports said oil filter such that said oil filter is located by the side of said oil pump housing;

said front casing having an integral conduit portion constituting said oil passage defining means.

4. The engine as set forth in claim 3 wherein said oil filter is located rearwardly of and below said oil pump housing.

5. The engine as set forth in claim 3 wherein said oil pump further comprises first and second upstream pipes integrally connecting said oil filter mounting bracket to said oil pump housing such that said first upstream pipe conducts therethrough lubricating oil from said oil pump to said oil filter and said second upstream pipe conducts therethrough lubricating oil from said oil filter to said oil passage.

6. The engine as set forth in claim 5 wherein said front casing has a front end wall, and said conduit portion of said front casing is disposed inside said front end wall.

7. The engine as set forth in claim 6 wherein said front end wall is formed with an opening for installing said sprocket and chain in place within said front casing, said opening being sealingly closed by a cover after installation of said sprocket and chain is completed.

8. The engine as set forth in claim 7, further comprising an oil sump for supplying lubricating oil to said oil pump, said front casing being sealed to said front end of said cylinder block for collecting lubricating oil leaking from said oil pump and allowing it to flow toward said oil sump.

9. The engine as set forth in claim 8 wherein said front casing further has a seating installing thereon a water pump housing of a water pump and thereby defining first and second water passages between said front casing and said water pump housing, said first and second water passages extending in the crosswise directions of said first and second banks for conducting coolant from said water pump to said first and second banks, respectively.

10. The engine as set forth in claim 9, further comprising a cam chain for said first bank, said front end of said cylinder block having at said first bank a recess for receiving therein said cam chain, said oil passage extending along said front end of said cylinder block in the crosswise direction of said first bank and disposed between said cam chain and said first water passage.

* * * * *